US006862360B2

(12) United States Patent
Tsai

(10) Patent No.: US 6,862,360 B2
(45) Date of Patent: Mar. 1, 2005

(54) SPEAKER SYSTEM

(76) Inventor: Jen-Hui Tsai, 3F, No. 3, Lane 67, Ching Shing Road, Wen Shen Suburb, Taipei (TW)

( * ) Notice: Subject to any disclaimer, the term of this patent is extended or adjusted under 35 U.S.C. 154(b) by 361 days.

(21) Appl. No.: 09/839,945

(22) Filed: Apr. 19, 2001

(65) Prior Publication Data

US 2002/0154788 A1 Oct. 24, 2002

(51) Int. Cl.[7] ..... H04R 25/00

(52) U.S. Cl. ..... 381/351; 381/345; 381/349; 381/335; 381/386; 181/148; 181/160

(58) Field of Search ..... 381/335, 152, 381/337, 338, 345, 349, 351–353, 386, 395; 181/149–151, 156

(56) References Cited

U.S. PATENT DOCUMENTS 4,054,748 A * 10/1977 Balogh ..... 381/387
4,398,619 A * 8/1983 Daniel
4,482,026 A * 11/1984 Stehlin, Jr. ..... 181/152
4,690,244 A * 9/1987 Dickie ..... 181/146
5,092,424 A * 3/1992 Schreiber et al. ..... 181/145
5,471,019 A * 11/1995 Maire ..... 181/156
5,576,522 A * 11/1996 Taso
6,176,346 B1 * 1/2001 Wiener ..... 181/199

* cited by examiner

*Primary Examiner*—Huyen Le
*Assistant Examiner*—Dionne Harvey
(74) *Attorney, Agent, or Firm*—Peter F. Corless; Steven M. Jensen; Edwards & Angell, LLP

(57) ABSTRACT

A speaker system is provided which includes a sound box and a speaker mounted in the sound box. The sound box is divided into a plurality of air chambers, each of which is formed with at least an air dissipating hole connecting the atmosphere of the box and at least an air passing hole connecting at least a neighboring air chamber, so as to generate behind the speaker pressurized air cushions corresponding to each frequency band of the frequency response of the speaker. Meanwhile, upon reaching the air dissipating hole of each air chamber the air cushions are generated depressurized and vanished at an appropriate timing so that formerly air cushions do not interfere with those generated in succession; therefore each frequency band of the frequency response of the speaker is provided with an appropriate and independent pressurized air cushion so that high fidelity sound frequencies can be reproduced.

3 Claims, 4 Drawing Sheets

PRIOR ART FIG. 1

SPEAKER SYSTEM

BACKGROUND OF THE INVENTION

1. Field of the Invention

The present invention relates to speaker systems, and more particularly to a speaker system with a structure which is able to reproduce high fidelity of sound frequencies.

2. Description of Related Art

FIG. 1 is a sectional view of a conventional speaker system wherein the inner space of the sound box 100 forms an air chamber; at the lower part on the front side of the sound box 100 (the right hand side in FIG. 1) an air dissipating hole 102 is formed for connecting the air chamber inside the sound box 100, and a speaker 120 is installed on the upper part.

The speaker 120 comprises a frame 122, and a vibrational cone 124 suspended and mounted on the frame 122. As shown in FIG. 1, a permanent magnet 126 is provided on the backside of the frame 122. A moving coil 128 with coils (not shown) wound thereon is disposed at the end of the cone 124 close to the permanent magnet 126. In addition, a damper 130 is installed between the moving coil 128 and the frame 122. At the instant when a signal of a certain frequency is inputted to the speaker 120, through the coil of the moving coil 128 there flows an electric current corresponding to the frequency so as to make the moving coil 128 become an electromagnet. As such, the permanent magnet 126 pulls the moving coil 128 backwards (i.e., to the left hand side in the Figure), and at the same time, the damper 130 is extended. After this, the magnetic force disappears, the moving coil 128 and the cone 124 immediately bounce forward (i.e., bouncing to the right hand side in the Figure) due to the recovery force of the damper 130, and a sound is generated by the cone 124 compressing air in front.

The aforementioned illustrates the principle of sound generation in a conventional speaker system. The reason why a conventional speaker system has the sound box structure as shown in FIG. 1 is that dampers 130 capable of providing appropriate elastic force in the ranges of frequency response of the speaker 120 were not available. Generally speaking, if the damper 130 is too rigid, it will make the cone 124 bounce back rapidly no matter what frequency of the sound generated by the speaker is, and therefore a low frequency of high fidelity can not be generated; and if the damper 130 is too soft, it will not be able to make the cone 124 bounce back rapidly regardless of the frequency of the sound generated by the speaker, so that the speaker will not be able to generate a high frequency of high fidelity. As such, conventionally a speaker 120 having a relatively soft damper 130 is generally used in a conventional speaker system, wherein the speaker 120 is mounted on the sound box 100. By the action of the permanent magnet 126, in which it pulls the moving coil 128 backwards, the cone 124 compresses the air behind speaker 120 through the holes 132 of the frame 122. Behind the speaker 120 (i.e., inside the sound box 100) instant air pressure (hereunder referred to as "pressurized air cushion") is generated. Such a pressurized air cushion is utilized to cooperate with the damper 130, enabling the speaker 120 with the relatively soft damper 130 to generate a high frequency of high fidelity. The aforementioned pressurized air cushion is generated instantly, immediately after its performance is completed, it depressurizes through the aforementioned air dissipating holes 120 and disappears.

In theory, in the configuration of the above mentioned speaker system, when the speaker 120 generates a sound of different sound frequency, there must be a different corresponding pressure behind it, so as to enable the speaker 120 to generate a sound frequency of high fidelity in each frequency range of the frequency response. However, it is not easy to generate different pressurized air cushion in one specific air chamber inside sound box 100. Therefore the conventional speaker system as constructed in FIG. 1 still cannot allow the speaker 120 to generate a sound frequency of high fidelity in each frequency range of the frequency response.

Furthermore, even if pressurized air cushions of different pressures can be generated within a single sound box 100, it is difficult for the air dissipating hole 102 of a fixed diameter to make the pressurized air cushions of different pressures to disappear instantly, therefore it is possible for the next air cushion to be generated already prior to the disappearance of the previous air cushion. In such a situation the air cushions interfering with but not independent from each other; moreover, it is not only incapable of improving the speaker's ability to reproduce the original sound, but possible that the sound quality of the speaker is deteriorated.

This invention has been developed to resolve the above mentioned problems and its objective is to provide a speaker system that is capable of generating behind its speaker pressurized air cushions corresponding to each frequency range of the frequency response of the speaker, so as to have an appropriate as well as independent air cushion in cooperation with the speaker in each frequency range of frequency response of the speaker, and therefore capable of generating a sound frequency closer to that of the inputted sound signal.

SUMMARY OF THE INVENTION

In order to achieve the above mentioned objective, the preset invention provides a speaker system comprising: a sound box with an interior divided into a plurality of air chambers, each air chamber being formed with at least an air passing hole connecting at least a neighboring air chamber, and an air dissipating hole connecting the atmosphere; and a speaker retained in a mounting opening formed in the sound box, which connects one of the air chambers.

When a speaker generates a sound of higher frequency, the wavelength of the air waves generated by the compressing of the air on the back side of the speaker by a cone provided in the speaker is shorter, and therefore diffusion of the air waves is weaker. When a speaker generates a sound of lower frequency, the wavelength of the air waves generated by compressing the air on the back side of the speaker by the cone provided in the speaker is longer, and therefore diffusion of the air waves is stronger. By the application of the principle that the lower the frequency the stronger the diffusion is, the speaker system of the present invention with a sound box of the above-mentioned structure is therefore able to generate pressurized air cushions in an instant in the air chambers corresponding to the frequency bands according to the sound frequencies generated by the spear, and through the air dissipating holes of each air chamber already-formed and actioned air cushion can disappear in time without interfering with that generated in succession. As such, pressurized air cushions corresponding to each frequency band of the frequency response of the speaker, can be generated on the backside of the speaker and therefore the objective of the present invention can be achieved.

In order to farther understand the structural features as well as the technological content of the present invention, please refer to the following detailed description with accompanying drawings. It is to be understood that the drawings accompanied in the following are only for the purpose of illustration and are not meant to limit the scope of the present invention.

DETAILED DESCRIPTION OF PREFERRED EMBODIMENT

First Preferred Embodiment

Figure 1:
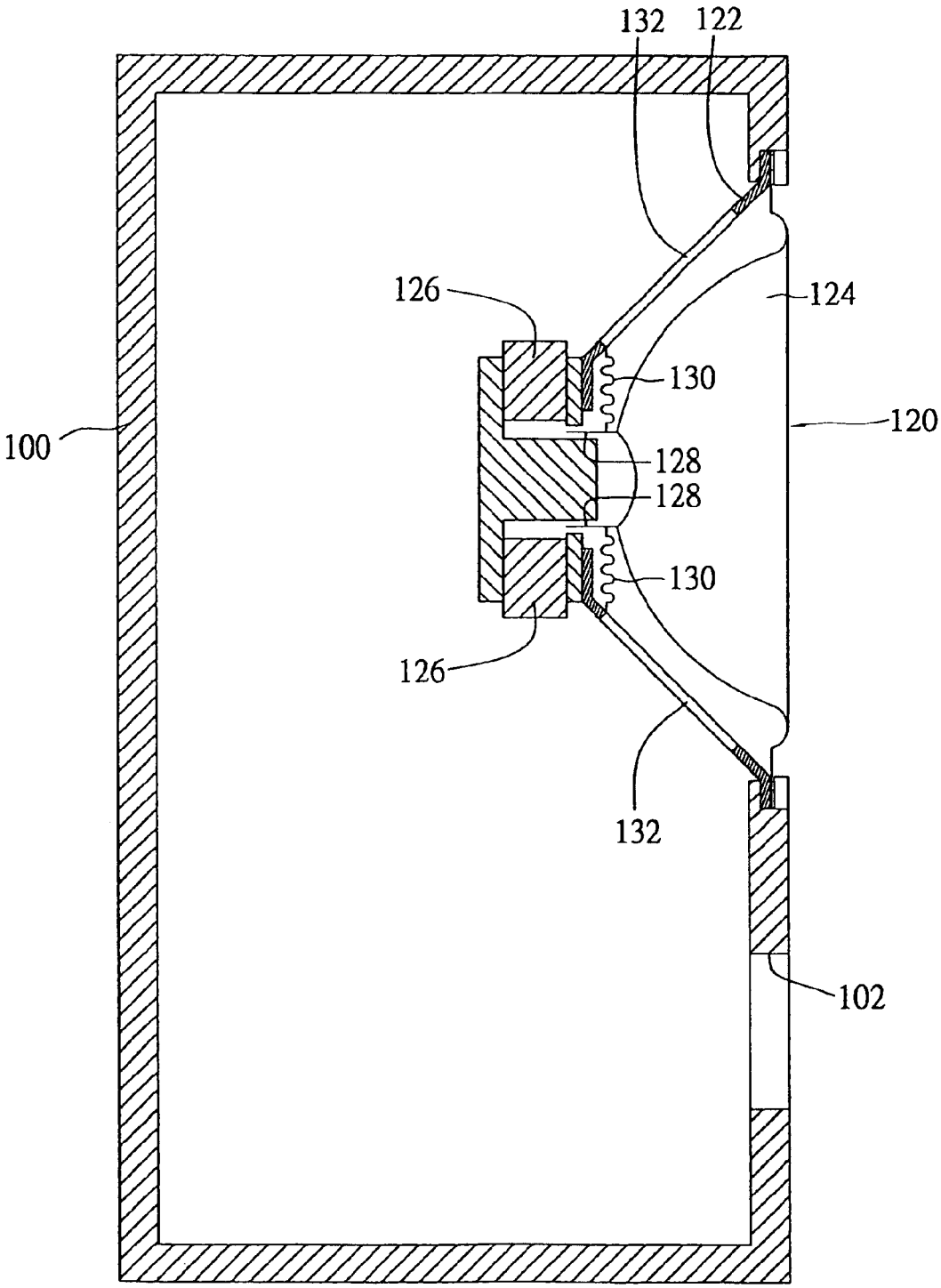
FIG. 1 is a sectional view of a conventional speaker system.
Figure 2:
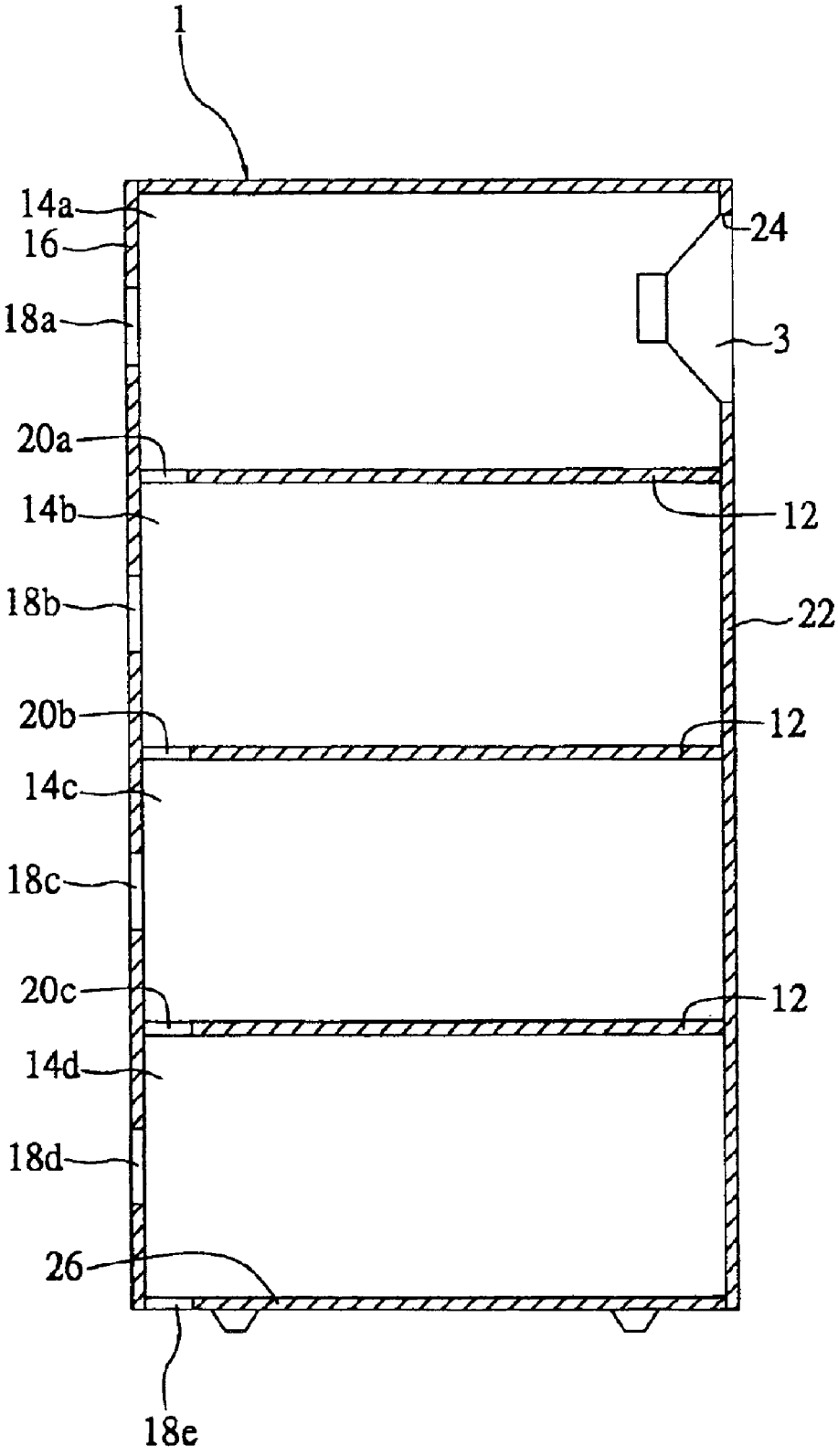
FIG. 2 is a section view of a first preferred embodiment of the speaker system according to the present invention.

FIG. 2 is a sectional view of a first preferred embodiment of the speaker system according to the present invention. As shown in the figure, the speaker system of the present invention comprises a sound box 1, and a speaker 3 mounted on the sound box 1.

As shown in FIG. 2, the interior of the sound box 1 is divided by three pieces of dividers 12 into four air chambers 14*a*, 14*b*, 14*c*, and 14*d*. In this preferred embodiment, there are three section boards 12 parallely positioned at equally-distance intervals; however, the embodiment is not limited to it.

Further, as shown in the Figure, there are air dissipating holes 18*a*, 18*b*, 18*c*, and 18*d* formed on a back side board 16 of the sound box 1, each at a position corresponding to one of the air chambers, and air passing holes 20*a*, 20*b*, and 20*c* each formed on one of the dividers 12 at a position close to the back side board 16. As shown, there is also an air dissipating hole 18*e* formed at the bottom of air chamber 14*d* on a bottom side board 26 of the sound box 1; however, if the air dissipating hole 18*d* is sufficiently effective to make a pressurized air cushion disappear rapidly, then the air dissipating hole 18*e* is not necessarily required. Furthermore, a speaker mounting opening 24 is formed on a front side board 22 of the sound box 1 at a position corresponding to the air chamber 14*a*, and the speaker 3 is retained and received in the speaker mounting opening 24.

In the preferred embodiment illustrated by FIG. 2, even though the air dissipating holes 18*a*, 18*b*, 18*c*, and 18*d* are formed on the backside board 16 of the sound box 1 (the embodiment is not limited to it), they are not necessarily limited to these embodiments and can also be formed on the left side board or the right side board of the sound box 1.

Figure 3:
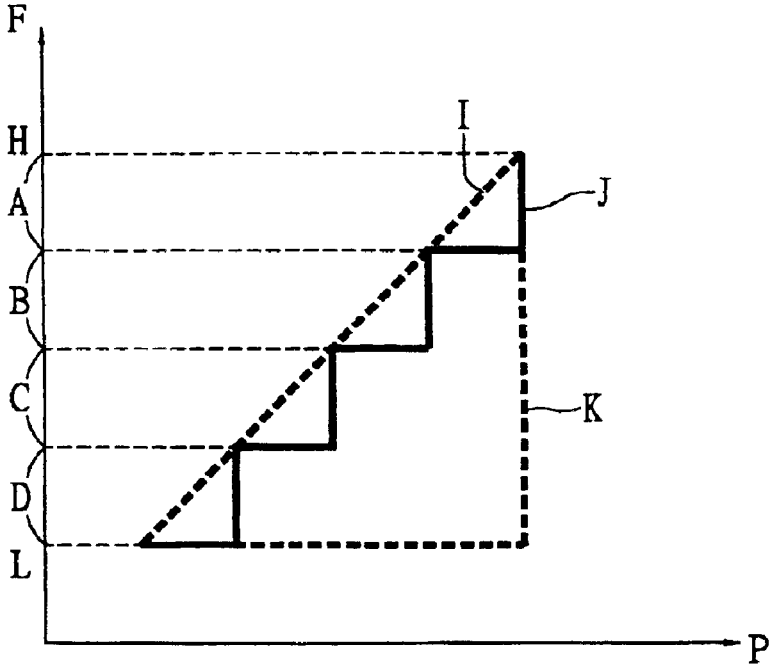
FIG. 3 is a graph showing the relationship between the frequency of the sound generated by the speaker and the pressure of the air cushion in the speaker system of FIG. 2.

FIG. 3 is a graph showing the relationship between frequency F of the sound generated by the speaker of the speaker system in FIG. 2, and the pressure of air cushion P. The functions of speaker systems according to the present invention will be explained in cooperation with FIG. 2 and FIG. 3.

As mentioned earlier, the lower the frequency of sound generated by a speaker, the stronger the diffusion of the air waves generated by compressing the air on the backside of the speaker by the cone of the speaker. As such, in the first preferred embodiment of FIG. 2, if sizes, shapes, and positions of the dissipating holes 18*a*, 18*b*, 18*c*, and 18*d*, and the air passing holes 20*a*, 20*b*, and 20*c* are appropriately designed based on the size of the speaker 3, the frequency response of the speaker 3, and the size of the sound box 1, for example, while the depth×width×height of the sound box 1 are 40 cm×30 cm×120 cm, the speaker 3 is an eight-inch speaker, and diameters of the air dissipating holes 18*a*, 18*b*, 18*c* and 18*d* and the air passing holes 20*a*, 20*b*, and 20*c* are made 8 cm each, as shown in FIG. 3, the range L~H of the frequency response of the speaker 3 can be divided into four (the same number as the number of air chambers) frequency bands A, B, C, and D. Thus, when the band of frequency of sound generated by the speaker 3 is within the frequency band A, in the air chamber 14*a* on the back side of the speaker 3 an instant air pressure is generated due to the backward movement of the cone of the speaker, and at this instant, the air pressure, prior to being depressurized through the air dissipating hole 18*a* and the air passing hole 20*a*, has formed an air cushion which enables the speaker 3 to generate a sound of high fidelity within frequency band A. Since the air cushion can be depressurized through the two air holes 18*a* and 20*a* and disappears rapidly after it has already actioned, it will not interfere with the air cushions generated subsequently.

Further, when the frequency band of the sound generated by the speaker 3 is within the frequency band B, because the wavelength of the air waves generated during the compression of air on the backside of the speaker 3 by the cone of the speaker is shorter, the air wave, prior to generating an air cushion in the air chamber 14*a*, through the air passing hole 20*a*, diffuses towards the air chamber 14*b* (at this moment since the wavelength of the air wave is not sufficiently low, it would not be able to continue its diffusion into the air chamber 14*c*), and then forms an air cushion of lower density in the connected air chambers 14*a* and 14*b*. After this air cushion has caused the speaker 3 to sufficiently perform the generation of sound in the frequency range B, it can be depressurized rapidly through the three air dissipating holes 18*a*, 18*b*, and 20*b*, so as not to interfere with the air cushions generated in succession.

Similarly, when the frequency band of the sound generated by the speaker 3 is within the frequency bands C and D, air cushions of corresponding pressures can be formed individually in the connected air chambers of 14*a*, 14*b*, and 14*c*, and of 14*a*, 14*b*, 14*c*, and 14*d*. After the air cushions has already actioned, they can be depressurized and disappear rapidly individually through the four air dissipating holes 18*a*, 18*b*, 18*c*, and 20*c*, and through the five air dissipating holes 18*a*, 18*b*, 18*c*, 18*d*, and 18*e*. As a result, the air cushions produced would not interfere with each other.

As shown in FIG. 3, a line I is an ideal line representing the complete and continuous frequencies of sound generated by a speaker can theoretically generated, a line J is a line representing the relationship between frequency F and pressure P that can be obtained from the speaker system with a plurality of air chambers according to the present invention, and a link K is a line representing the relationship between frequency F and pressure P of a conventional speaker system with a single air chamber. As such, compared to the prior art, the speaker system according to the present invention is capable of generating a relatively complete and continuous frequency of sound from the speaker. Furthermore, as it can be seen in FIG. 3, the line J is formed into four levels corresponding to the sound box with four air chambers of the speaker system in FIG. 2. If the interior of the sound box is divided into a greater number of air chambers, the correlation curve formed can further approach the line I so as to further improve the quality of sound reproduction of the speaker.

Second Preferred Embodiment

Figure 4:
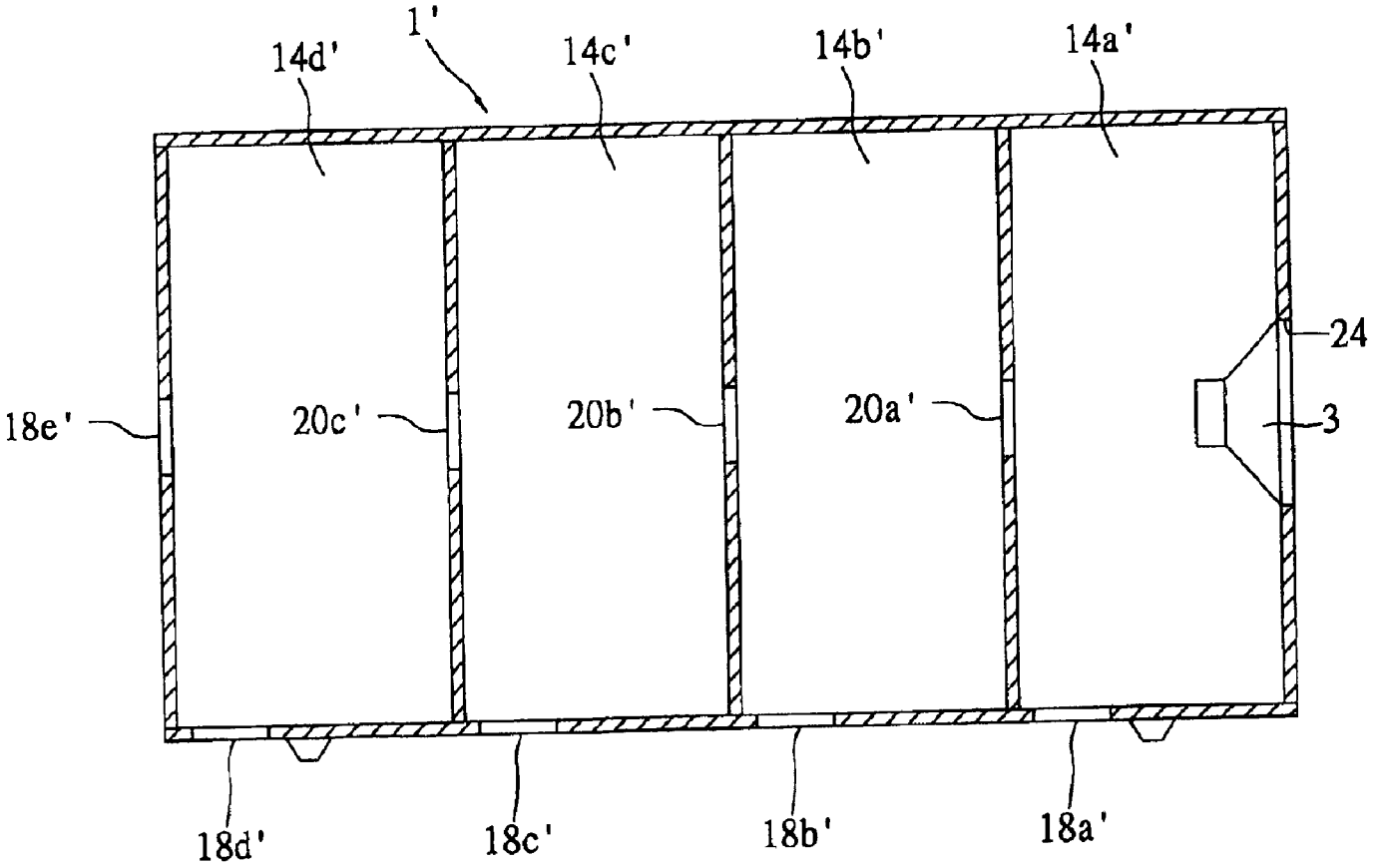
FIG. 4 is a sectional side view of a second embodiment of the speaker system according to the present invention.

FIG. 4 is a sectional side view of a second preferred embodiment of the speaker system according to the present invention, wherein except for the fact that air chambers 14*a*', 14*b*', 14*c*' and 14' are arranged horizontally in a row, their principles of operation and functions are all the same as those in the speaker system of the first preferred embodiment shown in FIG. 2. Further, in FIG. 4 while air dissipating holes 18*a*', 18*b*', 18*c*', and 18*d*' are formed on the bottom surface of sound box 1' (the embodiment is not limited to it), they can also be formed on the top side surface, the left side surface, or the right side surface.

According to the present invention, the interior of the sound box with the mounted speaker is divided into a plurality of air chambers, wherein each of the air chambers has an air passing hole connecting its next air chamber and an air dissipating hole connecting the exterior. Each of the air chambers with the connected dissipating air holes is used to generate a pressurized air cushion on the backside of the speaker corresponding to each frequency range of frequency response of the speaker. Meanwhile, the air dissipating hole of each air chamber is utilized to enable elimination of the air cushion at the appropriate timing so as to avoid interference with the air cushions generated in succession. Thus the speaker is able to have a proper and independent pressurized air cushion to cooperate within each frequency range of the frequency response of the speaker so as to enable reproduction of high fidelity sound frequencies.

The speaker systems described above are only examples of preferred embodiments of the speaker systems according to the present invention. It is to be understood that all modifications and variations with equivalent functions that do not violate the principle and technology of the present invention should be included in the scope of the claims to be described below.

What is claimed is:

1. A speaker system, comprising:

a sound box having an interior divided by a plurality of dividers into a plurality of air chambers, each of the air chambers being formed with an air passing hole on each of the dividers connected to at least a neighboring air chamber and at least an air dissipating hole connected to the atmosphere, wherein an air cushion formed in at least one of the air chambers is depressurized through one or more of the air passing holes and air dissipating holes so as not to interfere with air cushions subsequently generated;

a mounting opening is formed in the sound box and connected to one of the air chambers; and a speaker retained in the mounting opening.

2. The speaker system as set forth in claim 1, wherein the mounting opening is connected to a first air chamber of the sound box.

3. The speaker system as set forth in claim 1, wherein the dividers are parallely arranged in the sound box.

* * * * *